United States Patent [19]

King

[11] Patent Number: 4,808,007

[45] Date of Patent: Feb. 28, 1989

[54] DUAL VISCOSITY MIXER

[75] Inventor: L. Tony King, Long Beach, Calif.

[73] Assignee: Komax Systems, Inc., Long Beach, Calif.

[21] Appl. No.: 90,128

[22] Filed: Aug. 27, 1987

Related U.S. Application Data

[63] Continuation-in-part of Ser. No. 25,517, Mar. 13, 1987, abandoned, which is a continuation-in-part of Ser. No. 378,005, May 13, 1982, abandoned.

[51] Int. Cl.[4] ..... B01F 5/06

[52] U.S. Cl. ..... 366/337; 138/40; 261/78.1; 366/167; 366/336

[58] Field of Search ..... 366/101, 106, 107, 160, 366/161, 167, 173, 174, 176, 177, 336–340, 341; 138/40, 42; 137/896; 261/24, 78 R, 78 A

[56] References Cited

U.S. PATENT DOCUMENTS 3,749,377 7/1973 Slater et al. .
4,054,619 10/1977 Coverston .

*Primary Examiner*—Timothy F. Simone
*Attorney, Agent, or Firm*—Limbach, Limbach & Sutton

[57] ABSTRACT

A device for the mixing of two or more fluids is disclosed which comprises an elongated hollow tubular member which is constricted intermediate its ends with a mixing zone comprising (a) at least two cylindrical orifices whose axes are substantially parallel to the axis of the tubular member for carrying a first fluid and (b) a fluid entry port for discharging a second fluid substantially between said two cylindrical orifices. The device is particularly advantageous when used for the mixing of two fluids having widely disparate viscosities.

18 Claims, 3 Drawing Sheets

DUAL VISCOSITY MIXER

STATEMENT OF RELATED APPLICATIONS

The present application is a continuation in part of U.S. application Ser. No. 25,517 which was filed on Mar. 13, 1987, now abandoned which in turn is a continuation in part of U.S. application Ser. No. 378,005, filed on May 13, 1982, now abandoned.

FIELD OF INVENTION

The present invention deals with a static mixing apparatus capable of enhancing the speed and efficiency of mixing two liquids having widely disparate viscosities.

BACKGROUND OF THE INVENTION

It is common practice to mix particulate solids, liquids and gases with motionless mixers having, as the name implies, no moving parts. Mixers of this category consist of baffles of various types arranged sequentially in a tube or pipe. By a process of division and recombination, separate input components can be mixed or dispersed within one another at the output of said tube or pipe.

Difficulties are often experienced, however, when mixing materials of widely disparate viscosities and/or very different flow rates. For example, in the polymer field, it is at times desirable to mix very small quantities of a low viscosity material within a much larger quantity of a high viscosity material. When this is done, the low viscosity material tends to tunnel through the mixing elements without blending with the high viscosity material to any great extent. As an example, one might wish to mix a stream flowing at a rate of 7 gpm of a polymer having a viscosity of 30 million centipoises with a second stream traveling at 0.035 gpm of 6 centipoise material.

A variety of approaches have been attempted to produce an initial degree of dispersion or mixing at the injection point of the low viscosity material. These approaches have included, by way of illustration, the use of a multiplicity of injection ports around the circumference of a pipe. A second approach has consisted of the use of a relatively small diameter pipe for carrying the low viscosity material which passes through the diameter of the main pipe carrying the high viscosity material. The small diameter pipe is configured to have a plurality of holes used for injecting the low viscosity fluid. A common problem of such devices having parallel path outlets is that the low viscosity fluid injection apertures become differentially plugged resulting in asymmetric distribution.

It is well known that one of the mechanisms that allows for mixing of fluids is diffusion. However, when dealing with high viscosity materials which typically produce laminar flow, diffusion rates are very small. It is known that the rate of mass transfer N of the diffusion component measured in moles per second per unit area is equal to the diffusivity D multiplied by the local concentration gradient dC/dr. Thus, $$N \alpha D(dC/dr)$$

Since D is small in high viscosity material, it is necessary to make the concentration gradient dC/dr large in order to maximize the value of the mass transfer rate N.

As being typical of a difficult mixing system is the development of a continuous polymerization of methyl methacrylate to produce the acrylic resin. This requires the introduction and intermolecular mixing of less than about one percent of a very low viscosity additive, about 6 cp, and to a high viscosity melt system. The latter viscosity is about 15 million cp at the operating shear rate. The problem is exacerbated by the desire to minimize thermal and mechanical abuse to the final product. First thought is given to the use of in-line or motionless, also called static, mixers. Although they represent savings in power and capital investment, when introducing a low viscosity liquid into a high viscosity process stream, motionless mixers tend to be ineffective allowing the low viscosity liquid to simply tunnel through the high volume, high viscosity fluid.

Others have suggested the use of compounding extruders to mix additives into the polymer. This introduces heat, shear history and high energy costs. It was found, however, that perhaps a static mixer could be used if the appropriate entrance conditions were met. This recognition, in and of itself, represents a rather significant departure from prior teachings which tend to encourage the use of static or motionless mixers only in turbulent flow conditions. When engaging the polymerization of methyl methacrylate, the flow is highly laminar with a Reynolds number of approximately $10^{-4}$. As a solution to this problem, a distribution head was devised which, when used in conjunction with a static or motionless mixer, provides an effective mixing element principally due to the "sheeting" of the low viscosity additive prior to the introduction of the process stream into the motionless mixer element.

SUMMARY OF THE INVENTION

Referring again to the equation presented above, the rate of mass transfer N can be increased by decreasing dr. In principle, this can be accomplished by placing a relatively small diameter pipe across the diameter of a larger pipe or tube, the small diameter pipe having a thin slot along its length. The fluid component exiting the slot would be introduced in the form of very thin sheets, but the clogging problems discussed above would nevertheless plague this approach.

These problems have been solved by presenting a device comprising an elongated substantially hollow tubular member having a longitudinal axis in which the hollow tubular member is constricted intermediate its ends with a mixing zone. The mixing zone in turn comprises at least two orifices for carrying a first fluid having substantially circular cross-sections and having longitudinal axes which are substantially parallel to the longitudinal axis of the substantially hollow tubular member. The orifices are situated and sized within the substantially hollow tubular member such that their substantially circular cross-sections have a point of substantial mutual tangency. A fluid entry port for discharging a second fluid at a point substantially coincident with the point of substantial mutual tangency of the orifices is also provided.

DETAILED DESCRIPTION OF THE DRAWINGS

FIGS. 5A, 6A, 7A, and 8A depict various configurations of orifices making up various embodiments of the present invention.

Figure 2A:
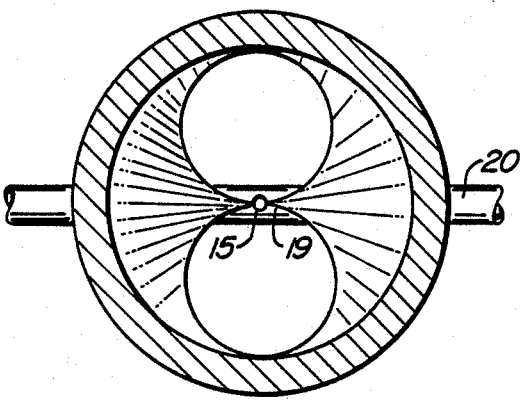
FIG. 2A is a plan view of the device of FIG. 1.
Figure 2B:
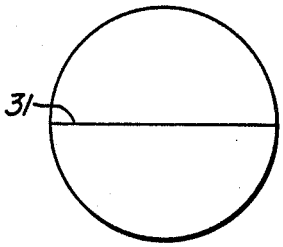
FIG. 2B is a representation of the liquid flow pattern resulting from the embodiment shown in FIG. 2A.

FIGS. 5B, 6B, 7B, and 8B are similar to FIG. 2B in that a representation is made of the liquid flow patterns emanating from the device of the present invention when FIGS. 5A, 6A, 7A, and 8A are employed, respectively.

Figure 9:
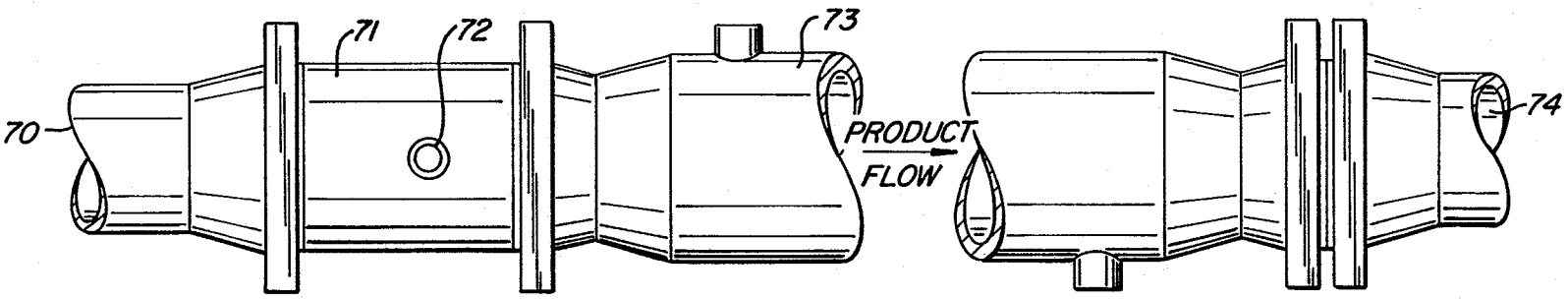

FIG. 9 is a perspective view of a typical mixing element employing both the distribution head of the present invention as well as a downstream, longitudinally aligned, static mixer.

DETAILED DESCRIPTION OF THE INVENTION

Figure 1:
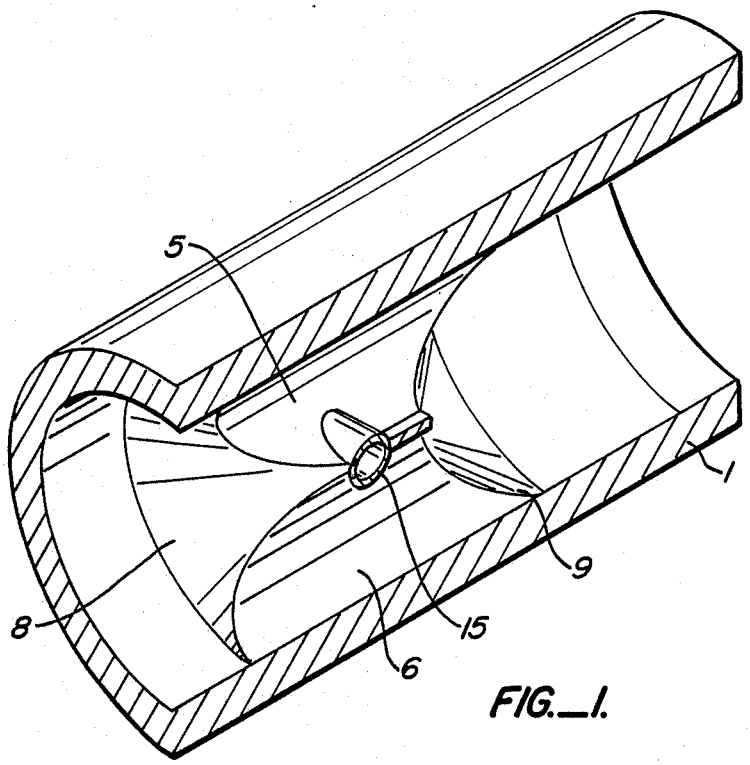
FIG. 1 is an isometric representation of an embodiment of the present invention.

Referring to FIG. 1, mixing device 10 comprises a substantially hollow tubular member 1 which is constricted at 9, said constriction comprising orifices 5 and 6 for the passage of a relatively high viscosity fluid. It is contemplated that the cross-sections of the orifices are substantially circular, said definition encompassing obvious modifications such as oval shapes and the like.

It is contemplated that the two orifices for carrying the first fluid have longitudinal axes which are substantially parallel to the longitudinal axis of substantially hollow tubular member 1, and that orifices 5 and 6 be sized such that their substantially circular cross-sections have a point of substantial mutual tangency, shown at location 19 (FIG. 2A).

The low viscosity fluid entry port 15 preferably comprises an orifice located in hollow tube 20, which is shown radially extending through the side walls of elongated hollow tubular member 1. The low viscosity fluid is caused to enter the motionless mixer of the present invention through the hollow tube and its rate of discharge is controllable by pumping means (not shown).

As shown in FIGS. 1 and 2A, hollow tube 20 passes radially through tubular member 1 through the centerpoints of each orifice 5, 6. This has been done for the sake of symmetry. It is, however, appropriate to pass hollow tube 20 through the side walls of hollow tubular member 1 at other points such as, for example, 90° from the position shown while achieving the beneficial mixing characteristics desired herein. It is crucial in practicing the present invention that low viscosity fluid entry port 15 be positioned such that the low viscosity fluid is discharged at a point substantially coincident with the point of substantial mutual tangency 19 of orifices 5 and 6. By so situating entry port 15, the low viscosity fluid forms an elongated flat plane 31 across the diameter of the pipe as shown in FIG. 2B. This greatly enhances molecular fusion between the low viscosity and high viscosity fluids. This increases the surface area available for diffusion by a factor typically 25 to 50 times, while at the same time increasing the value of dC/dr.

As stated previously, the present invention is particularly advantageous in mixing fluids of markedly contrasting viscosities. Ideally, the viscosity ratio of the first and second fluids should be approximately 1000:1 or more to most adequately take advantage of the motionless mixer presented herein.

Constriction 9 forming the mixing zone from which the two or more orifices are formed can assume a number of configurations. It has been found that when the side walls of constriction 9 are radially perpendicular to the circumference of hollow tubular member 1, some of the fluid being mixed can settle in dead zones proximate the interior side walls of the hollow tubular member. Thus, it is preferable, as shown in FIG. 1, to slope the side walls of constriction 9, said slope most typically being at a 45° angle to the centerline of hollow tubular member 1.

Figure 3:
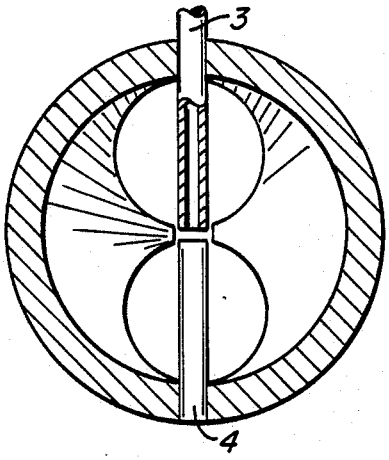
FIG. 3 is a second embodiment of the present invention showing a modified feed port for the low viscosity fluid.

FIG. 3 depicts yet another embodiment of the present invention whereby instead of providing a single hole 15 as a discharge port for the low viscosity fluid as shown in FIGS. 1 and 2, the discharge port of FIG. 3 comprises an orifice formed at the distal ends of a solid rod 3 and hollow tube 4. As in the previous embodiments, the hollow tube and solid rod pass radially through the side walls of elongated hollow tubular member 1 discharging the low viscosity fluid at point of tangency 19 of orifices 5 and 6. Low viscosity fluid is caused to enter the motionless mixer of the present invention through the hollow tube, and its rate of discharge is directly related to the spacing between the distal ends of the hollow tube and solid rod.

The advantages realized in the employment of the embodiment shown in FIG. 3 over that shown in FIGS. 1 and 2 are simply in the ease with which one can control the rate of discharge of the low viscosity fluid and, secondarily, increased ease in preventing the low viscosity discharge port from being clogged. Thus, by contacting tube 3 and rod 4 the open end of the tube can be somewhat cleaned, while more intensive cleaning can be achieved by actually removing the hollow tube from tubular member 1.

Figure 5A:
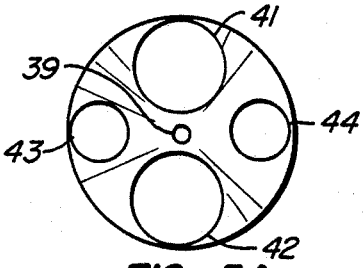
Figure 5B:
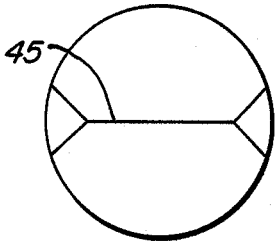

FIGS. 5A, 6A, 7A, and 8A show various alternative embodiments in the placement of the various orifices to achieve elongated flat planes of the low viscosity fluids. For example, FIG. 5A shows a four orifice pattern, each orifice being displaced 90° about the center line of hollow tubular member 1. Ideally, orifices 41 and 42 are of a larger diameter than orifices 43 and 44. As such, entry port 39 is substantially positioned at the point of tangency only of orifices 41 and 42 at the 0° and 180° points about hollow tubular number 1. This configuration produces elongated flat plane 45 as depicted in FIG. 5B.

Figure 6A:
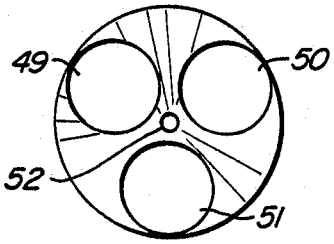
Figure 6B:
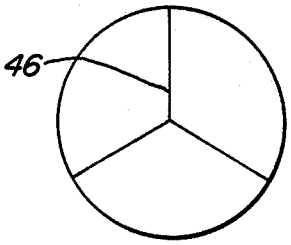

Turning to FIG. 6A, a three orifice pattern is depicted, each orifice 49, 50, and 51 being displaced 120° about hollow tubular number 1. In this configuration, it is contemplated that each orifice be of substantially the same cross-section such that fluid entry port 52 is positioned substantially at the point of tangency of all three orifices. Such a hole pattern forms elongated flat planes 46 as shown in FIG. 6B.

Figure 7A:
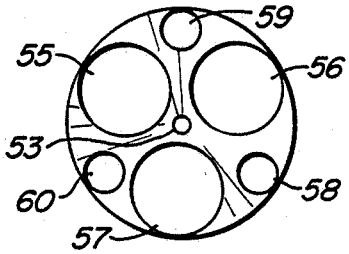
Figure 7B:
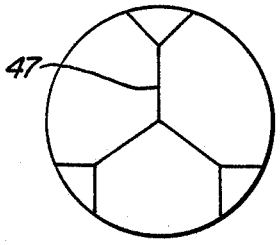

FIG. 7A is similar to FIG. 6A with the addition of reduced orifices 58, 59, and 60 located between main orifices 55, 56, and 57. As such, orifices appear about hollow tubular number 1 every 60° with orifices at 0°, 120° and 240° being the main orifices. As in FIG. 6A, entry port 53 is shown located at the point substantial mutual tangency of the main orifices 55, 56, and 57. Such a configuration produces elongated flat planes 47 and shown in FIG. 7B.

Figure 8A:
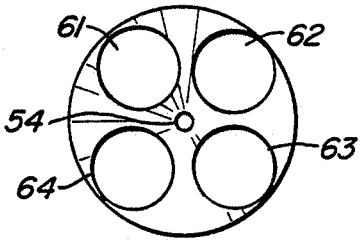
Figure 8B:
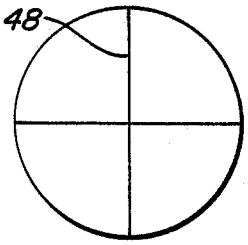

Lastly, the embodiment of FIG. 8A is depicted with orifices 61, 62, 63, and 64 being displaced 90° from one another about hollow tubular number 1. In this embodiment, all four orifices are of substantially the same size resulting in entry port 54 being situated at the point of substantial mutual tangency of all four orifices. Such a configuration forms elongated flat planes 48 as shown in FIG. 8B.

It is quite evident that one can create a liquid output of specific configuration such as shown in FIGS. 2B, 5B, 6B, 7B, and 8B by simply selecting different orifice patterns. This can prove advantageous in coupling the distribution head of the present invention with a downstream mixing device mixing up part of an overall liquid mixer. For example, FIG. 9 depicts distribution head 71 located downstream of liquid inlet 70 which ideally carries a first high viscosity fluid. Low viscosity entry port 72 is used to introduce the low viscosity liquid. Depending upon which configuration one selects, elongated flat planes of low viscosity liquid exits the distribution head within a stream of high viscosity liquid and enters static mixer 73.

Figure 4:
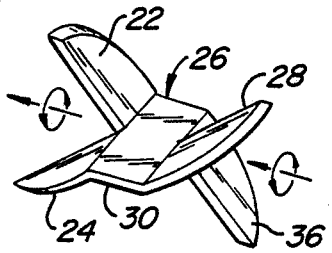
FIG. 4 is perspective view of a single mixing element which optionally may be made the part of a motionless or static mixing conduit located downstream from the device of, for example, FIG. 1.

Ideally, static mixer 73 can be fitted with a number of self-nesting abutting axially overlapping elements such as element 26 depicted in FIG. 4. Mixing elements of this nature are described in applicant's U.S. Pat. No. 3,923,288, which issued on Dec. 2, 1975, the disclosure of which is incorporated by reference herein.

Turning once again to FIG. 4, mixing elements 26 are self-aligning and, when more than one are employed, abut and nest with adjacent elements to provide a close fit to the interior walls of orifices 5 and 6 and provide a slight "spring" such that no permanent connection between adjacent elements or between the elements and the interior wall surfaces of orifices 5 and 6 is required. Each region of axial overlap between elements provides a mixing matrix in producing complex velocity vectors into the materials. A flat, axially aligned portion 30 of each element provides a "drift space" subsequent to each mixing matrix for the liquids to recombine prior to encountering the next matrix.

It is noted that element 26 includes a central flat portion 30, the plane of which is intended to be generally aligned with the longitudinal axis of orifices 5 and 6. First and second ears 22 and 24, rounded or otherwise configured at their outside peripheries for a general fit to the walls of orifices 5 and 6 are bent upward and downward from the flat portion 30. A second pair of ears 36 and 28 at the opposite side of flat portion 30 are bent downward and upward, respectively. The outside peripheral edges of ears 28 and 36 are also rounded or otherwise configured for a general fit to the walls of orifices 5 and 6. Alternating elements are mirror images of the elements which precede them and are generally alternated through the interior of orifices 5 and 6, the total number of elements used depending upon the materials being mixed and the degree of mixing desired. Such a configuration is most desirable when the mixing apparatus of the present invention is employed as a mixer for fluids traveling in turbulent flow.

By using such an arrangement, the liquid stream exiting orifice 74 is more highly mixed at lower pressure drops than was previously believed to be possible. In fact, by using this arrangement, many industrial production processes can be successfully converted from batch methods to continuous flow technology. Mass transfer operations, particularly those involving mechanical mixers, can be performed very effectively using in-line static or motionless mixers resulting in savings of power and capital investment while improving process control. This is all rendered possible by using the distribution head of the present invention which maximizes the interfacial area of the additive by minimizing the interfacial thickness between the additive and main liquid flow.

I claim:

1. A device for the mixing of two or more fluids comprising an elongated substantially hollow tubular member having a longitudinal axis in which said hollow tubular member is constricted intermediate its ends with a mixing zone comprising (A) at least two orifices for carrying a first fluid having substantially circular cross-sections and having longitudinal axes which are substantially parallel to the longitudinal axis of the substantially hollow tubular member, said orifices being situated and sized within the said substantially hollow tubular member such that said substantially circular cross-sections have a point of substantial mutual tangency; and (B) A fluid entry port for discharging the second fluid at a point substantially coincident with the point of substantial mutual tangency of said orifices.

2. The device of claim 1 wherein the side walls of said constriction are tapered with respect to the side walls of the elongated hollow tubular member.

3. The device of claim 2 wherein said taper is approximately 45° with respect to the side walls of the elongated hollow tubular member.

4. The device of claim 1 wherein said second fluid entry port comprises an orifice formed at the distal ends of a solid rod and hollow tube, said solid rod and hollow tube radially extending through the side walls of said elongated hollow tubular member.

5. The device of claim 1 wherein said fluid entry port is configured from a hole in a hollow tube which passes through the center points of each orifice and extends radially through the side walls of said elongated hollow tubular member.

6. The device of claim 4 wherein said mixing zone comprises two orifices and said solid rod and hollow tube forming said second entry port pass through the body and side walls of said elongated hollow tubular member between said two orifices.

7. The device of claim 1 wherein said mixing zone comprises four orifices for carrying said first fluid and a fluid entry port for discharging said second fluid substantially at the point of tangency of at least two of said orifices.

8. The device of claim 7 wherein each of said four orifices are located at 0°, 90°, 180°, and 270° about said substantially hollow tubular member.

9. The device of claim 8 wherein each of said four orifices are of approximately the same cross-sectional area to one another.

10. The device of claim 8 wherein the orifices located at 0° and 180° about said substantially hollow tubular member are larger in cross-sectional area than said orifices located at 90° and 270°.

11. The device of claim 1 wherein said mixing zone comprises three orifices for carrying said first fluid and a fluid entry port for discharging said second fluid substantially at the point of mutual tangency of said three orifices.

12. The device of claim 11 wherein each of said three orifices are of approximately the same cross-sectional area to one another.

13. The device of claim 12 wherein the three orifices are located at 0°, 120°, and 240° about said substantially hollow tubular member.

14. The device of claim 1 wherein said mixing zone comprises six orifices for carrying said first fluid and fluid entry port for discharging said second fluid substantially at the point of tangency of at least three of said orifices.

15. The device of claim 14 wherein the orifices are located at 0°, 60°, 120°, 180°, 240°, and 300°, about said substantially hollow tubular member.

16. The device of claim 15 wherein the orifices located at 0°, 120°, and 240° about said substantially hollow tubular member are larger in cross-sectional area than said orifices located at 60°, 180°, and 300°.

17. The device of claim 1 further comprising a static mixer located downstream of said hollow tubular member.

18. The device of claim 17 wherein said static mixer comprises a conduit having a longitudinal axis, and having fitted therein one or more abutting, self-nesting elements, wherein adjacent elements are configured as mirror images of one another, each element having lengths along the longitudinal axes of the conduit wherein adjacent elements axially overlap defining mixing matrices inducing both counter-rotating angular velocities relative to said longitudinal axis and simultaneous inward and outward radial velocities relative to said longitudinal axis on materials moving through said mixing matrices, each element having a length along the longitudinal axis wherein said elements do not axially overlap, the axial non-overlap lengths of said elements being the length of the longitudinal axis defining draft spaces for the recombination of said liquids subsequent to movement through the mixing matrices.

* * * * *